US011051112B2

(12) United States Patent
Doy

(10) Patent No.: US 11,051,112 B2
(45) Date of Patent: Jun. 29, 2021

(54) MULTIPLE AUDIO TRANSDUCERS DRIVING A DISPLAY TO ESTABLISH LOCALIZED QUIET ZONES

(71) Applicant: Cirrus Logic International Semiconductor Ltd., Edinburgh (GB)

(72) Inventor: Anthony S. Doy, Los Gatos, CA (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/223,835

(22) Filed: Dec. 18, 2018

(65) Prior Publication Data

US 2019/0215614 A1 Jul. 11, 2019

Related U.S. Application Data

(60) Provisional application No. 62/615,145, filed on Jan. 9, 2018.

(51) Int. Cl.

| | |
|---|---|
| ***H04R 1/40*** | (2006.01) |
| ***H04R 17/00*** | (2006.01) |
| ***H04R 7/04*** | (2006.01) |
| *H04R 1/02* | (2006.01) |

(52) U.S. Cl.

CPC ..... *H04R 17/00* (2013.01); *H04R 7/045* (2013.01); *H04R 1/025* (2013.01); *H04R 2400/01* (2013.01); *H04R 2440/05* (2013.01); *H04R 2499/15* (2013.01)

(58) Field of Classification Search

CPC ..... H04R 7/04; H04R 7/7045; H04R 17/00; H04R 2400/01; H04R 2440/05; H04R 2499/11; H04R 2499/15; H04R 7/045

See application file for complete search history.

(56) References Cited

U.S. PATENT DOCUMENTS

| | | | | |
|---|---|---|---|---|
| 4,535,205 | A * | 8/1985 | Ravinet | H04R 17/025 367/163 |
| 6,522,760 | B2 * | 2/2003 | Azima | H04R 1/24 381/152 |
| 6,554,098 | B1 * | 4/2003 | Komura | H04R 1/02 181/173 |
| 6,985,596 | B2 * | 1/2006 | Bank | H04R 9/025 381/152 |
| 9,173,030 | B2 * | 10/2015 | Suzuki | G06F 1/1605 |
| 9,191,768 | B2 * | 11/2015 | Kano | H04R 3/12 |
| 9,392,371 | B2 * | 7/2016 | Nabata | G10K 11/178 |
| 9,596,531 | B1 * | 3/2017 | Zhang | H04R 1/028 |
| 9,880,625 | B2 * | 1/2018 | Harris | G06F 3/016 |
| 10,003,872 | B2 * | 6/2018 | Pellikka | H04R 7/045 |
| 10,271,154 | B2 * | 4/2019 | Bocko | H04R 1/2811 |
| 10,506,336 | B1 * | 12/2019 | Lesso | H04R 3/00 |
| 10,547,950 | B2 * | 1/2020 | Xiang | H04R 3/00 |
| 10,560,781 | B2 * | 2/2020 | Anderson | H04R 7/045 |
| 10,567,884 | B2 * | 2/2020 | Miyoshi | G10K 11/1785 |

(Continued)

*Primary Examiner* — Ryan Robinson
(74) *Attorney, Agent, or Firm* — Jackson Walker L.L.P.

(57) ABSTRACT

A method for mechanically driving a display screen to produce acoustic sound may include mechanically driving a first mechanical transducer mechanically coupled to the display screen to generate acoustic sound from the display screen and controlling a second mechanical transducer mechanically coupled to the display screen at a specific location to apply an acoustic null to the specific location in order to localize generation of the acoustic sound from the display screen.

18 Claims, 4 Drawing Sheets

(56) References Cited

U.S. PATENT DOCUMENTS

| | | | | |
|---|---|---|---|---|
| 2010/0054492 | A1* | 3/2010 | Eaton | H04R 3/12 381/74 |
| 2013/0250502 | A1* | 9/2013 | Tossavainen | G06F 3/016 361/679.01 |
| 2016/0313796 | A1* | 10/2016 | Kim | G06F 3/016 |
| 2017/0289661 | A1* | 10/2017 | Hose | H04R 7/045 |
| 2019/0191240 | A1* | 6/2019 | Ham | H04R 1/2834 |
| 2019/0220095 | A1* | 7/2019 | Ogita | H04R 1/26 |
| 2020/0037419 | A1* | 1/2020 | Scott | H05B 45/00 |

* cited by examiner

MULTIPLE AUDIO TRANSDUCERS DRIVING A DISPLAY TO ESTABLISH LOCALIZED QUIET ZONES

RELATED APPLICATION

The present disclosure claims priority to U.S. Provisional Patent Application Ser. No. 62/615,145, filed Jan. 9, 2018, which is incorporated by reference herein in its entirety.

FIELD OF DISCLOSURE

The present disclosure relates in general to a mobile device, and more particularly, to using one or more mechanical transducers to drive a display to generate audio and one or more other mechanical transducers to drive the display to establish localized audio quiet zones.

BACKGROUND

Traditionally, a small speaker (typically referred to as a "receive," "rec" or "Rx" speaker) generates audio playback of a mobile device in a "phone call" mode of the device. In many mobile designs, this receive speaker was located at an upper front face of the device, generally located behind a front panel of the device with a small slot provided to localize the sound when a user of the device holds the device to the user's ear.

With the advent of touch-screen controlled devices, featuring full edge-to-edge glass fronts with displays beneath, the receive speaker was often enabled by forming a slot into the front glass and situating the speaker behind the slot, with the active display area stopping short of the area of the receive speaker. This reverse side mounting and venting (amongst other front facing functions) prevents the active display area from becoming fully as large as the glass itself, typically leading to inactive (dark) areas at the top and/or bottom of the mobile device. As full edge-to-edge mobile designs emerge, alternate solutions are desired to bring audio signals to the surface of the glass front without obscuring or otherwise compromising the display beneath the glass.

Multiple transducers may be used to enable surface audio in a display-based device, such that the surface of the display screen itself acts as an acoustic transducer to generate sound. In certain applications, it may be desired that only designated areas of a display are acoustically driven. For example, in a mobile device used close to the ear, it may be desirable that the sound generated by the display surface is localized to the user's ear, for privacy purposes. However, the nature of display materials, which are typically mechanically stiff in nature, often results in the issue that even if driven at one corner or area of the display, the whole of the display tends to emit acoustically. This whole surface display design is very different from previous designs which have a speaker "firing" through a port in the top front portion of the phone, that creates a localized, point source of audio with minimum leakage to the immediate area outside the user's ear.

Thus, with a full surface of a display being driven, this audio leakage may compromise privacy on calls. In other words, others near a user may be able to hear audio that the user may not desire the others to hear. With traditional designs that use speakers and acoustic ports, people who are near the mobile device are typically unable to hear the received audio. Accordingly, methods and systems are desired for localizing display surface audio in a mobile device.

SUMMARY

In accordance with the teachings of the present disclosure, the disadvantages and problems associated with localizing surface-generated audio with a mobile device may be reduced or eliminated.

In accordance with embodiments of the present disclosure, a method for mechanically driving a display screen to produce acoustic sound may include mechanically driving a first mechanical transducer mechanically coupled to the display screen to generate acoustic sound from the display screen and controlling a second mechanical transducer mechanically coupled to the display screen at a specific location to apply an acoustic null to the specific location in order to localize generation of the acoustic sound from the display screen.

In accordance with embodiments of the present disclosure, a system for mechanically driving a display screen to produce acoustic sound may include a first mechanical transducer mechanically coupled to the display screen and configured to be mechanically driven in order to generate acoustic sound from the display screen and a second mechanical transducer mechanically coupled to the display screen at a specific location and configured to apply an acoustic null to the specific location in order to localize generation of the acoustic sound from the display screen.

Technical advantages of the present disclosure may be readily apparent to one having ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
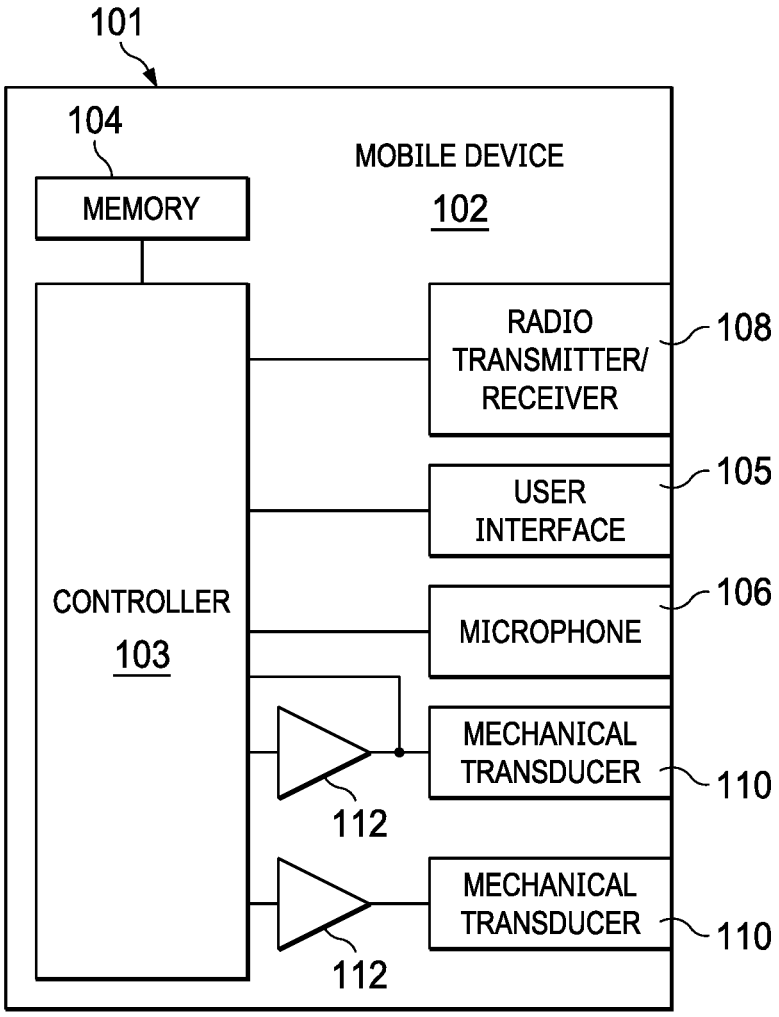
FIG. 1A illustrates a block diagram of selected components of an example mobile device, in accordance with embodiments of the present disclosure.

FIG. 1A illustrates a block diagram of selected components of an example mobile device 102, in accordance with embodiments of the present disclosure. As shown in FIG. 1A, mobile device 102 may comprise an enclosure 101, a controller 103, a memory 104, a user interface 105, a microphone 106, a radio transmitter/receiver 108, a plurality of mechanical transducers 110, and a plurality of amplifiers 112.

Enclosure 101 may comprise any suitable housing, casing, or other enclosure for housing the various components of mobile device 102. Enclosure 101 may be constructed from plastic, metal, and/or any other suitable materials. In addition, enclosure 101 may be adapted (e.g., sized and shaped) such that mobile device 102 is readily transported on a person of a user of mobile device 102. Accordingly, mobile device 102 may include but is not limited to a smart phone, a tablet computing device, a handheld computing device, a personal digital assistant, a notebook computer, or any other device that may be readily transported on a person of a user of mobile device 102.

Controller 103 is housed within enclosure 101 and may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, controller 103 may interpret and/or execute program instructions and/or process data stored in memory 104 and/or other computer-readable media accessible to controller 103.

Memory 104 may be housed within enclosure 101, may be communicatively coupled to controller 103, and may include any system, device, or apparatus configured to retain program instructions and/or data for a period of time (e.g., computer-readable media). Memory 104 may include random access memory (RAM), electrically erasable programmable read-only memory (EEPROM), a Personal Computer Memory Card International Association (PCMCIA) card, flash memory, magnetic storage, opto-magnetic storage, or any suitable selection and/or array of volatile or non-volatile memory that retains data after power to mobile device 102 is turned off.

User interface 105 may be housed at least partially within enclosure 101, may be communicatively coupled to controller 103, and may comprise any instrumentality or aggregation of instrumentalities by which a user may interact with mobile device 102. For example, user interface 105 may permit a user to input data and/or instructions into mobile device 102 (e.g., via a keypad and/or touch screen), and/or otherwise manipulate mobile device 102 and its associated components. User interface 105 may also permit mobile device 102 to communicate data to a user, e.g., by way of a display device.

Microphone 106 may be housed at least partially within enclosure 101, may be communicatively coupled to controller 103, and may comprise any system, device, or apparatus configured to convert sound incident at microphone 106 to an electrical signal that may be processed by controller 103, wherein such sound is converted to an electrical signal using a diaphragm or membrane having an electrical capacitance that varies as based on sonic vibrations received at the diaphragm or membrane. Microphone 106 may include an electrostatic microphone, a condenser microphone, an electret microphone, a microelectromechanical systems (MEMS) microphone, or any other suitable capacitive microphone.

Radio transmitter/receiver 108 may be housed within enclosure 101, may be communicatively coupled to controller 103, and may include any system, device, or apparatus configured to, with the aid of an antenna, generate and transmit radio-frequency signals as well as receive radio-frequency signals and convert the information carried by such received signals into a form usable by controller 103. Radio transmitter/receiver 108 may be configured to transmit and/or receive various types of radio-frequency signals, including without limitation, cellular communications (e.g., 2G, 3G, 4G, LTE, etc.), short-range wireless communications (e.g., BLUETOOTH), commercial radio signals, television signals, satellite radio signals (e.g., GPS), Wireless Fidelity, etc.

A mechanical transducer 110 may be housed at least partially within enclosure 101 or may be external to enclosure 101, may be communicatively coupled to controller 103 (e.g., via a respective amplifier 112), and may comprise any system, device, or apparatus made with one or more materials configured to generate electric potential or voltage when mechanical strain is applied to mechanical transducer 110, or conversely to undergo mechanical displacement or change in size or shape (e.g., change dimensions along a particular plane) when a voltage is applied to mechanical transducer 110. In some embodiments, a mechanical transducer may comprise a piezoelectric transducer made with one or more materials configured to, in accordance with the piezoelectric effect, generate electric potential or voltage when mechanical strain is applied to mechanical transducer 110, or conversely to undergo mechanical displacement or change in size or shape (e.g., change dimensions along a particular plane) when a voltage is applied to mechanical transducer 110.

In some embodiments, mechanical transducer 110 may comprise a structure similar to a dynamic loudspeaker, which employs a lightweight diaphragm mechanically coupled to a rigid frame via a flexible suspension that constrains a voice coil to move axially through a cylindrical magnetic gap. When an electrical signal is applied to the voice coil, a magnetic field is created by the electric current in the voice coil, making it a variable electromagnet. The coil and the driver's magnetic system interact, generating a mechanical force that causes the coil (and thus, the attached cone) to move back and forth, thereby reproducing sound under the control of the applied electrical signal coming from an amplifier.

Although specific example components are depicted above in FIG. 1A as being integral to mobile device 102 (e.g., controller 103, memory 104, user interface 105, microphone 106, radio transmitter/receiver 108, mechanical transducers 110, amplifiers 112), a mobile device 102 in accordance with this disclosure may comprise one or more components not specifically enumerated above.

Figure 1B:
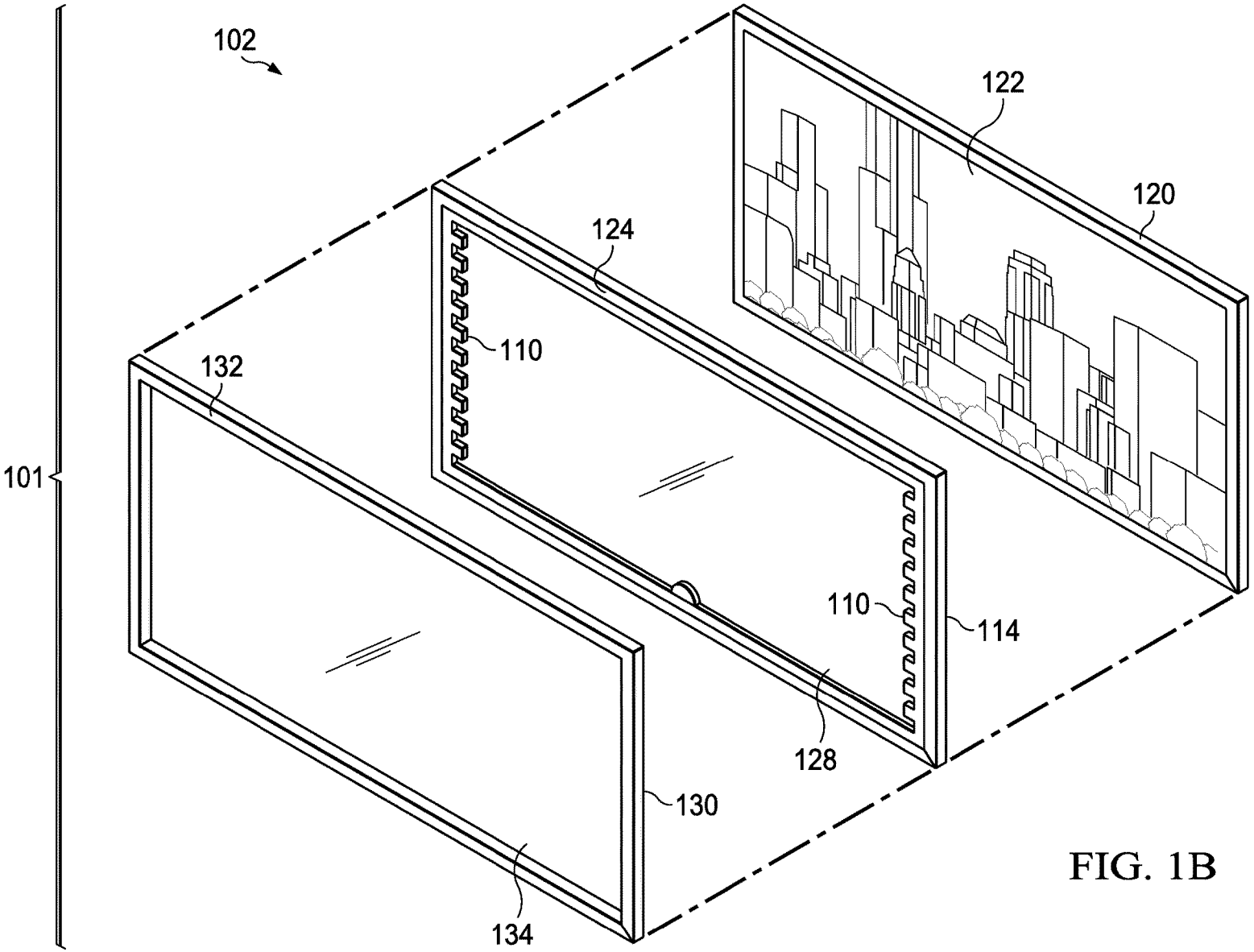
FIG. 1B illustrates an exploded perspective view of selected components of an example mobile device, in accordance with embodiments of the present disclosure.

FIG. 1B illustrates an exploded perspective view of selected components of example mobile device 102, in accordance with embodiments of the present disclosure. As shown in FIG. 1B, enclosure 101 may include a main body 120, a mechanical transducer assembly 114, and a cover assembly 130, such that when constructed, mechanical transducer assembly 114 is interfaced between main body 120 and cover assembly 130. Main body 120 may house a number of electronics, including controller 103, memory 104, radio transmitter/receiver 108, and/or microphone 106, as well as a display (e.g., a liquid crystal display) of user interface 105.

Mechanical transducer assembly 114 may comprise a frame 124 configured to hold and provide mechanical structure for one or more mechanical transducers 110 (which may be coupled to controller 103) and transparent film 128.

Cover assembly 130 may comprise a frame 132 configured to hold and provide mechanical structure for transparent cover 134. Transparent cover 134 may be made from any suitable material (e.g., ceramic) that allows visibility through transparent cover 134, protection of mechanical transducer 110 and display 122, and/or user interaction with display 122.

Figure 2A:
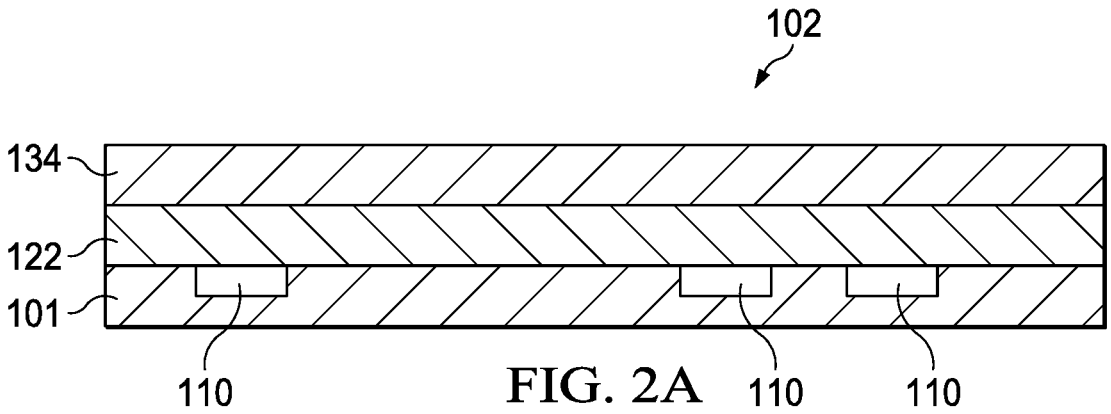
FIG. 2A illustrates a side elevation view of selected components of an example mobile device, in accordance with embodiments of the present disclosure.
Figure 2B:
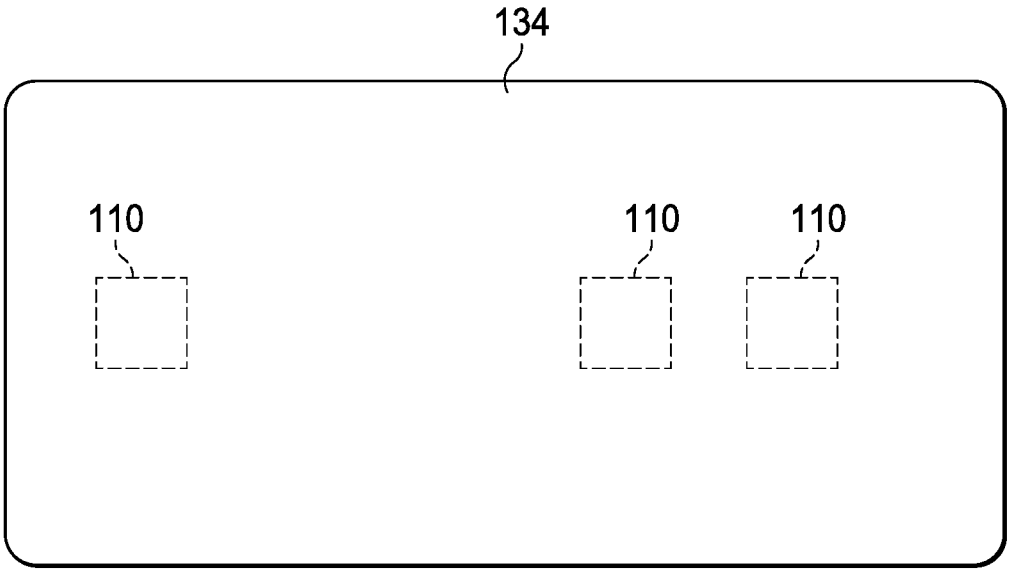
FIG. 2B illustrates a top plan view of selected components of an example mobile device, in accordance with embodiments of the present disclosure.

Although FIG. 1B illustrates mechanical transducer assembly 114 being situated between cover assembly 130 and display 122, in some embodiments, mechanical transducer assembly 114 may reside "behind" display 122, such that display 122 is situated between cover assembly 130 and mechanical transducer assembly 114. In addition, although FIG. 1B illustrates mechanical transducers 110 located at edges of mechanical transducer assembly 114 (and thus, at or near the edge of display 122), mechanical transducers 110 may be located at any suitable location below cover 134 and/or display 122. For example, FIG. 2A illustrates a side elevation view of selected components of another embodiment of example mobile device 102, in accordance with embodiments of the present disclosure, while FIG. 2B illustrates a top plan view of selected components of example mobile device 102, in accordance with embodiments of the present disclosure; both FIGS. 2A and 2B show that mechanical transducers 110 may be located in any suitable location within mobile device 102.

Although FIGS. 1A-2B depict certain numbers of mechanical transducers 110 (e.g., two mechanical transducers 110 in FIGS. 1A and 1B and three mechanical transducers 110 in FIGS. 2A and 2B), mobile device 102 may include any suitable number of mechanical transducers 110.

Mechanical transducers, including piezoelectric transducers, are typically used to convert electric signals into mechanical force. Thus, when used in connection with display 122 and/or cover 134, one or more mechanical transducers 110 may cause vibration on a surface of cover 134, which in turn may produce pressure waves in air, generating human-audible sound. Accordingly, in operation of mobile device 102, one or more mechanical transducers 110 may be driven by respective amplifiers 112 under the control of controller 103 in order to generate acoustical sound by vibrating the surface of cover 134.

However, mechanical transducers, including piezoelectric transducers and coil-based dynamic transducers, may also function in reverse, such that mechanical force applied to a mechanical transducer 110 may result in the mechanical transducer generating an electrical signal indicative of the mechanical force applied.

Accordingly, in accordance with the systems and methods disclosed herein, mobile device 102 may comprise a plurality of mechanical transducers 110 driving a common screen (e.g., display 122, cover 134), wherein one or more of the mechanical transducers 110 may drive the common screen in order to generate human-audible sound, and one or more of other mechanical transducers 110 may be used as sensors, converting a measure of mechanical energy local to such sensor mechanical transducers 110—which may be indicative of an undesired displacement or mechanical vibration of the screen—into electrical signals (e.g., voltages) indicative of the undesired displacement or mechanical vibration of the screen. Further, the electrical signals produced by a mechanical transducer 110 acting as a sensor may be received by controller 103, which may implement a control circuit to inject a cancelling signal (e.g., scaled amounts of drive current from a synthesized high-impedance source) to mechanically control the mechanical transducer 110 acting as a sensor to cancel out the undesired displacement or mechanical vibration of the screen, resulting in a reduced mechanical (and hence reduced acoustic) output in a local area specific to the mechanical transducer 110 acting as a sensor.

While only two mechanical transducers 110 may be necessary to implement such a system (e.g., one mechanical transducer 110 driving a screen at one location and another mechanical transducer sensing and cancelling in another location of the screen), the use of multiple transducers 110 may lead to greater cancellation and localized control of cancellation, while also enabling different "active" acoustic areas on mobile device 102 in applications in which such flexibility is desirable.

Figure 3:
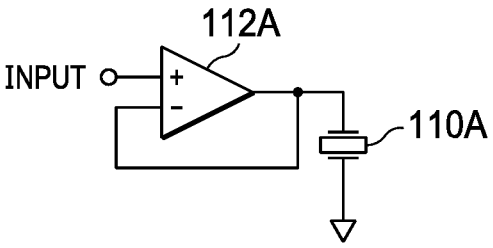
FIG. 3 illustrates a circuit diagram of an example amplifier and mechanical transducer for generating acoustical sound via a screen surface, in accordance with embodiments of the present disclosure.

FIG. 3 illustrates a circuit diagram of an example amplifier 112A and mechanical transducer 110A for generating acoustical sound via a screen surface, in accordance with embodiments of the present disclosure. As shown in FIG. 3, an amplifier 112A, which may be configured as a voltage-controlled voltage source, may receive an input signal and generate an appropriate output signal based on the input signal in order to drive mechanical transducer 110A directly, or in some cases such as when a Class D or switching amplifier is used, via a matching/filter network. In turn, mechanical transducer 110A may be mechanically coupled to a screen (e.g., display 122 and/or cover 134), and may cause mechanical movement/vibration of such screen in order to generate acoustical sound.

Figure 4:
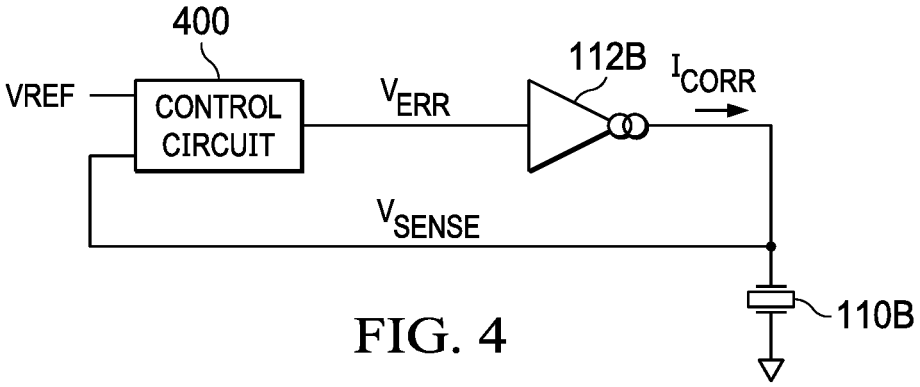
FIG. 4 illustrates a circuit diagram of an example amplifier and mechanical transducer for sensing mechanical energy and correcting for the sensed mechanical energy, in accordance with embodiments of the present disclosure.

FIG. 4 illustrates a circuit diagram of an example amplifier 112B and mechanical transducer 110B for actively sensing mechanical energy (e.g., at a screen surface) and correcting for the sensed mechanical energy with an opposing drive in order to establish a localized acoustic null on the screen surface proximate to mechanical transducer 110B, in accordance with embodiments of the present disclosure. In operation, mechanical transducer 110B may generate a voltage $V_{SENSE}$ across its terminals in response to mechanical displacement/vibration of mechanical transducer 110B. Voltage $V_{SENSE}$ may be sensed by a control circuit 400 (e.g., implemented by controller 103) which may compare voltage $V_{SENSE}$ to a reference voltage $V_{REF}$ in order to generate an error voltage $V_{ERR}$ Amplifier 112B, which may comprise a voltage-controlled current source, may generate a corrective current $I_{CORR}$ as a function of error voltage $V_{ERR}$ in order to generate an acoustic null on the screen surface proximate to mechanical transducer 110B.

Figure 5:
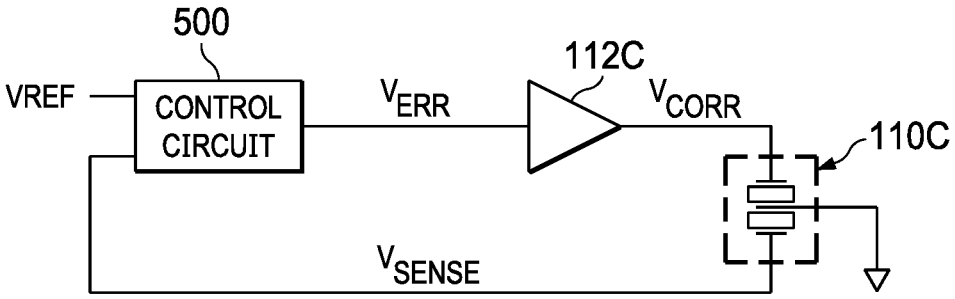
FIG. 5 illustrates a circuit diagram of another example amplifier and another mechanical transducer for sensing mechanical energy and correcting for the sensed mechanical energy, in accordance with embodiments of the present disclosure.

FIG. 5 illustrates a circuit diagram of an example amplifier 112C and a multi-layer mechanical transducer 110C for actively sensing mechanical energy (e.g., at a screen surface) and correcting for the sensed mechanical energy with an opposing drive in order to establish a localized acoustic null on the screen surface proximate to mechanical transducer 110C, in accordance with embodiments of the present disclosure. As shown in FIG. 5, mechanical transducer 110C may comprise a three-terminal device, such that one layer of mechanical transducer 110C may be used for driving mechanical movement while another layer of mechanical transducer 110C may be used for sensing mechanical movement. In operation, mechanical transducer 110C may generate a voltage $V_{SENSE}$ as shown in FIG. 5 in response to mechanical displacement/vibration of mechanical transducer 110C. Voltage $V_{SENSE}$ may be sensed by a control circuit 500 (e.g., implemented by controller 103) which may compare voltage $V_{SENSE}$ to a reference voltage $V_{REF}$ in order to generate an error voltage $V_{ERR}$. Amplifier 112C, which may comprise a voltage-controlled voltage source, may generate a corrective voltage $V_{CORR}$ as a function of error voltage $V_{ERR}$ in order to generate an acoustic null on the screen surface proximate to mechanical transducer 110C.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. A method for mechanically driving a display screen to produce acoustic sound, the method comprising:

mechanically driving a first mechanical transducer mechanically coupled to the display screen to generate acoustic sound from the display screen; and controlling a second mechanical transducer mechanically coupled to the display screen at a specific location to apply an acoustic null to the specific location in order to localize generation of the acoustic sound from the display screen, wherein the second mechanical transducer is configured to sense a localized mechanical energy proximate to the specific location.

2. The method of claim 1, further comprising electrically driving the second mechanical transducer responsive to the localized mechanical energy sensed in order to cancel the localized mechanical energy.

3. A method for mechanically driving a display screen to produce acoustic sound, the method comprising:

mechanically driving a first mechanical transducer mechanically coupled to the display screen to generate acoustic sound from the display screen; and controlling a second mechanical transducer mechanically coupled to the display screen at a specific location to apply an acoustic null to the specific location in order to localize generation of the acoustic sound from the display screen, wherein the second mechanical transducer is configured to sense a mechanical movement of the display screen proximate to the specific location.

4. The method of claim 3, further comprising electrically driving the second mechanical transducer responsive to the mechanical movement sensed in order to cancel the mechanical movement.

5. The method of claim 3, wherein the second mechanical transducer is configured to generate an electrical sense signal indicative of the mechanical movement.

6. The method of claim 5, further comprising driving the second mechanical transducer responsive to the electrical sense signal in order to cancel the mechanical movement.

7. The method of claim 5, wherein the electrical sense signal is a voltage.

8. The method of claim 3, wherein at least one of the first mechanical transducer and the second mechanical transducer comprises a piezoelectric transducer.

9. A system for mechanically driving a display screen to produce acoustic sound, the system comprising:

a first mechanical transducer mechanically coupled to the display screen and configured to be mechanically driven in order to generate acoustic sound from the display screen; and a second mechanical transducer mechanically coupled to the display screen at a specific location and configured to apply an acoustic null to the specific location in order to localize generation of the acoustic sound from the display screen, wherein the second mechanical transducer is configured to sense a localized mechanical energy proximate to the specific location.

10. The system of claim 9, wherein the second mechanical transducer is further configured to be electrically driven responsive to the localized mechanical energy sensed in order to cancel the localized mechanical energy.

11. A system for mechanically driving a display screen to produce acoustic sound, the system comprising:

a first mechanical transducer mechanically coupled to the display screen and configured to be mechanically driven in order to generate acoustic sound from the display screen; and a second mechanical transducer mechanically coupled to the display screen at a specific location and configured to apply an acoustic null to the specific location in order to localize generation of the acoustic sound from the display screen, wherein the second mechanical transducer is configured to sense a mechanical movement of the display screen proximate to the specific location.

12. The system of claim 11, wherein the second mechanical transducer is further configured to be electrically driven responsive to the mechanical movement sensed in order to cancel the mechanical movement.

13. The system of claim 11, wherein the second mechanical transducer is configured to generate an electrical sense signal indicative of the mechanical movement.

14. The system of claim 13, wherein the second mechanical transducer is further configured to be electrically driven responsive to the electrical sense signal in order to cancel the mechanical movement.

15. The system of claim 13, wherein the electrical sense signal is a voltage.

16. The system of claim 11, wherein at least one of the first mechanical transducer and the second mechanical transducer comprises a piezoelectric transducer.

17. The method of claim 1, wherein at least one of the first mechanical transducer and the second mechanical transducer comprises a piezoelectric transducer.

18. The system of claim 9, wherein at least one of the first mechanical transducer and the second mechanical transducer comprises a piezoelectric transducer.

* * * * *